US012305484B2

(12) United States Patent
Mitchell et al.

(10) Patent No.: US 12,305,484 B2
(45) Date of Patent: May 20, 2025

(54) PRE-POSITIONING A MELTABLE SEAL FOR PLUG AND ABANDONMENT

(71) Applicant: Halliburton Energy Services, Inc., Houston, TX (US)

(72) Inventors: David Lyall Mitchell, Singapore (SG); Michael Linley Fripp, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/978,828

(22) Filed: Nov. 1, 2022

(65) Prior Publication Data

US 2024/0141754 A1 May 2, 2024

(51) Int. Cl.

| | |
|---|---|
| ***E21B 34/14*** | (2006.01) |
| ***E21B 33/13*** | (2006.01) |
| ***E21B 36/00*** | (2006.01) |

(52) U.S. Cl.

CPC ..... *E21B 34/142* (2020.05); *E21B 33/13* (2013.01); *E21B 36/008* (2013.01); *E21B 2200/06* (2020.05)

(58) Field of Classification Search

CPC ... E21B 33/13; E21B 33/1208; E21B 2200/06
See application file for complete search history.

(56) References Cited

U.S. PATENT DOCUMENTS

| | | | |
|---|---|---|---|
| 8,249,461 | B2 | 8/2012 | Vaerndal |
| 9,441,446 | B2 | 9/2016 | Fripp et al. |
| 9,926,483 | B2 | 3/2018 | Murphree et al. |
| 9,982,506 | B2 | 5/2018 | Walton et al. |
| 10,138,701 | B2 | 11/2018 | Fripp et al. |
| 10,240,422 | B2 | 3/2019 | Fripp et al. |
| 10,240,427 | B2 | 3/2019 | Murphree et al. |
| 10,316,614 | B2 | 6/2019 | Fripp et al. |
| 10,533,392 | B2 | 1/2020 | Walton et al. |
| 10,597,983 | B2 | 3/2020 | Fripp et al. |
| 10,605,027 | B2 | 3/2020 | Walton et al. |
| 11,047,203 | B2 | 6/2021 | Fripp et al. |

(Continued)

FOREIGN PATENT DOCUMENTS

| | | | |
|---|---|---|---|
| EP | 3412748 | A1 | 12/2018 |
| WO | 2013048666 | A1 | 4/2013 |

(Continued)

OTHER PUBLICATIONS

International Search Report and Written Opinion for International Application No. PCT/US2022/049668 dated Jul. 20, 2023.

(Continued)

*Primary Examiner* — Theodore N Yao
(74) *Attorney, Agent, or Firm* — Scott Richardson; C. Tumey Law Group PLLC

(57) ABSTRACT

Systems and methods of the present disclosure relate to plug and abandonment operations for wells. A method comprises moving a sliding sleeve of a conduit to expose a meltable sealant that is pre-installed on an inner diameter (ID) of the conduit. The conduit is disposed in a wellbore, and the meltable sealant is configured to melt and flow upon heating. The meltable sealant is further configured to cool, solidify, and plug the conduit upon dissipation of heat.

20 Claims, 8 Drawing Sheets

(56) References Cited

U.S. PATENT DOCUMENTS

| | | | | |
|---|---|---|---|---|
| 11,118,423 | B1* | 9/2021 | Helms | E21B 33/128 |
| 11,136,850 | B2 | 10/2021 | Wellhoefer et al. | |
| 11,174,700 | B2 | 11/2021 | Fripp et al. | |
| 11,199,069 | B2 | 12/2021 | Fripp et al. | |
| 11,248,453 | B2 | 2/2022 | Fripp et al. | |
| 11,255,148 | B2 | 2/2022 | Greci et al. | |
| 11,286,741 | B2 | 3/2022 | Fripp et al. | |
| 11,299,955 | B2 | 4/2022 | Fripp et al. | |
| 11,377,950 | B2 | 7/2022 | Fripp et al. | |
| 11,448,042 | B1 | 9/2022 | Glaesman et al. | |
| 11,454,083 | B2 | 9/2022 | Asthana et al. | |
| 2013/0192833 | A1* | 8/2013 | Gano | E21B 36/00 166/373 |
| 2015/0034317 | A1* | 2/2015 | Skjold | E21B 36/008 166/288 |
| 2015/0101813 | A1 | 4/2015 | Zhao et al. | |
| 2015/0152708 | A1 | 6/2015 | Smith | |
| 2016/0177636 | A1 | 6/2016 | Greci et al. | |
| 2016/0319633 | A1* | 11/2016 | Cooper | E21B 34/142 |
| 2016/0348465 | A1* | 12/2016 | Schultz | E21B 33/13 |
| 2018/0274333 | A1 | 9/2018 | Gibb | |
| 2019/0003282 | A1* | 1/2019 | Doherty | E21B 33/146 |
| 2019/0203563 | A1 | 7/2019 | Gano et al. | |
| 2020/0325749 | A1 | 10/2020 | Fripp et al. | |
| 2021/0017441 | A1 | 1/2021 | Fripp et al. | |
| 2021/0032980 | A1 | 2/2021 | Fripp et al. | |
| 2021/0054719 | A1 | 2/2021 | Nichols et al. | |
| 2021/0148184 | A1 | 5/2021 | Helms et al. | |
| 2021/0148190 | A1* | 5/2021 | Ramakrishnan | E21B 29/12 |
| 2021/0155841 | A1 | 5/2021 | Ramakrishnan et al. | |
| 2021/0189830 | A1 | 6/2021 | Greci et al. | |
| 2021/0222509 | A1 | 7/2021 | Fripp et al. | |
| 2021/0332673 | A1 | 10/2021 | Fripp et al. | |
| 2021/0348472 | A1 | 11/2021 | Pendleton | |
| 2022/0168954 | A1 | 6/2022 | Fripp et al. | |
| 2022/0205341 | A1 | 6/2022 | Asthana et al. | |
| 2022/0243553 | A1 | 8/2022 | Shafer | |
| 2022/0316302 | A1 | 10/2022 | Zachariah et al. | |
| 2023/0022332 | A1* | 1/2023 | Macphail | E21B 43/12 |

FOREIGN PATENT DOCUMENTS

| | | | |
|---|---|---|---|
| WO | 2016204814 | A1 | 12/2016 |
| WO | 2016204822 | A1 | 12/2016 |
| WO | 2018200402 | A1 | 5/2019 |
| WO | 2019212499 | A1 | 11/2019 |
| WO | 2020018110 | A1 | 1/2020 |
| WO | 2020216649 | A1 | 10/2020 |
| WO | 2020237239 | A1 | 11/2020 |
| WO | 2021040793 | A1 | 3/2021 |
| WO | 2022038387 | A1 | 2/2022 |
| WO | 2022125067 | A1 | 6/2022 |
| WO | 2022132169 | A1 | 6/2022 |
| WO | 2022146419 | A1 | 7/2022 |
| WO | 2022191825 | A1 | 9/2022 |
| WO | 2022221790 | A1 | 10/2022 |

OTHER PUBLICATIONS

Netherlands Search Report and Written Opinion for NL Patent Application No. 2035675 dated Mar. 15, 2024. English Machine Translation with Original Untranslated Version, PDF file. 20 pages.

* cited by examiner

PRE-POSITIONING A MELTABLE SEAL FOR PLUG AND ABANDONMENT

BACKGROUND

Oil or gas wells may be plugged and abandoned due to economic viability. Decommissioning wells is expensive and requires a substantial amount of material to make a barrier seal to plug each well. In many applications, this needs either a rig or extensive mobilization and trips into the wellbore.

BRIEF DESCRIPTION OF THE DRAWINGS

These drawings illustrate certain aspects of some examples of the present disclosure and should not be used to limit or define the disclosure.

DETAILED DESCRIPTION

Figure 1:
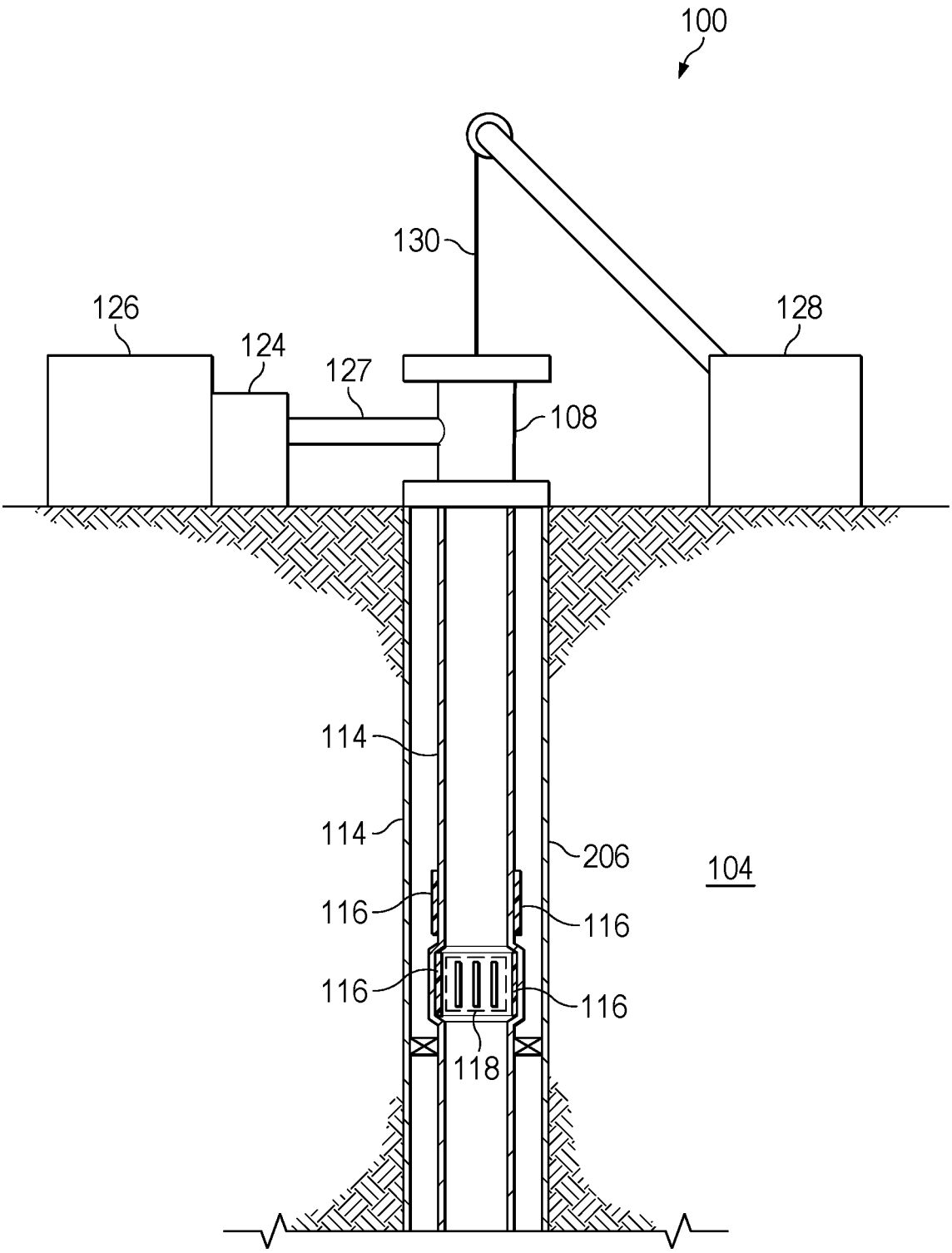
FIG. 1 illustrates a well site for plug and abandonment operations, in accordance with examples of the present disclosure.

The present disclosure relates to pre-positioning a sealing material to allow for a simpler wellbore abandonment. With the sealant already in the well, the only step is to activate the sealant. In particular examples, the sealant is activated with heat so that it melts and flows to form a seal in the well. Building a wellbore that is pre-made for abandonment allows a customer to reduce cost.

The sealant may be pre-positioned around/along the inner diameter (ID) and/or along/on the outer diameter (OD) of the tool string in order to provide sealing for multiple annuli. That is, the sealant may extend along an inner surface and an external surface of the conduit (e.g., band or sleeve of sealant). Thus, multiple levels of the seal are possible without: (1) needing to cut holes in the tool string; and (2) without needing to remove cement from the wellbore. Additionally, techniques as described herein may ensure that the sealant has reached all of the annuli to provide the sealing barriers.

The sealants include metal-based sealants that are dense. Carrying sufficient meltable metal-based sealant would require many wireline trips to avoid over stressing the wire/cable. Therefore, as described herein, the meltable material is pre-installed on the tool string (e.g., casing) before the tool is disposed in the wellbore. This means that the only trip is the trip for melting the sealant (i.e., seal activation). In some examples, a meltable material includes a metal with a low melting point (e.g., 100° C. to 300° C.) or a thermoplastic. Steel and aluminum are not considered meltable metals because although they can melt, the practicality of their high melting temperature makes them unsuitable and are thus considered as non-meltable materials. A thermoset, like an epoxy, is also not considered a meltable material.

In particular examples, a meltable sealant is pre-installed along the wall of the casing. When heated, this meltable sealant flows, collects on a stopper, solidifies, and then serves as a seal to block the wellbore. In some examples, the meltable sealant includes a metal alloy with a low melting point, such as a bismuth alloy. The alloy can be eutectic, hypoeutectic, or hypereutectic. These materials may be referred to as fusible alloys. The fusible alloy is a metal or a metal alloy with a melting point that is less than 300° C. (e.g., 100° C. to 300° C.). Pre-placing the fusible alloy enables the weight of the fusible metal to be supported by the strong casing string rather than a significantly weaker wireline cable. By pre-placement, it is likely that melting can be accomplished with a slickline run which is even less expensive.

In some examples, the fusible alloy is pre-positioned (1) on the ID of the casing behind a sliding sleeve, and (2) on the OD of the casing as an unprotected sleeve. During installation, a ball or dart is dropped to move the sleeve to expose the fusible alloy to a flow path of the conduit. The ball/dart also lodges in the conduit to create a support for the molten sealant.

After cooling, the sealant solidifies and forms a barrier. The ball/dart is no longer needed. As noted above, the ball/dart may slide open the sliding sleeve to allow access to the fusible alloy. In some examples, rather than using a ball, a spring-loaded valve may be disposed in the wall of the casing string and held in place with a material with a lower melting point than the meltable sealant, allowing for the spring-loaded valve to deploys quickly and provides a seal in the conduit.

In another example, the fusible alloy is not protected by a sliding sleeve. A dart is pumped to location and latches at the location. An exothermic chemical heater provides heat, which melts the fusible alloy. For example, the exothermic chemical reaction may include an oxidation reaction, such as the thermite reaction of iron oxide and aluminum. A hydration reaction may also be used, such as magnesium and water or calcium oxide and water. The exothermic chemical reactions may also include an acid in order to accelerate the energy release.

In some examples, the heater becomes part of the barrier (e.g., permanent placement/not retrievable), thereby allowing a lesser amount of fusible alloy to be used for sealing. This allows all required components to be pumped into position without a slickline run.

The meltable sealant has the option of being set or not-set. The fusible alloys expand as they solidify. This expansion assists in the sealing strength of the materials. The volume expansion from solidification is generally small but the materials result in a high sealing force. Bismuth alloys have 1% to 2% expansion as they solidify. Gallium alloys expand up to 3% on freezing. This compresses the alloy and enhances the seal. Other metal and metalloid alloys that can expand upon freezing include antimony, gallium, germanium, and plutonium.

In some examples, the meltable material may include a thermoplastic. The thermoplastic melts, flows, solidifies, to produce the seal. The thermoplastic provides a long-life barrier for plug-and-abandonment of a well. The meltable material may be a combination of thermoplastic and the fusible alloy. The molten thermoplastic has a higher viscosity than the molten fusible alloy. As a result, the molten thermoplastic can serve as a barrier to help hold the molten fusible alloy in position. Additionally, the thermoplastic and the fusible alloy may have different melting temperatures. Examples of thermoplastics include ABS, PE, Nylon, PEEK, PET, PPE, PVC, PEI, PPS, PI, and/or TPE.

FIG. 1 illustrates a well site for plug and abandonment operations, in accordance with examples of the present disclosure. The well site 100 includes a wellbore 102 extending into a subterranean formation 104 from a well head 108. The wellbore 102 may be a vertical wellbore as illustrated or it may be a deviated well. While the well site 100 is illustrated as land-based, it should be understood that the present techniques may also be applicable in offshore scenarios. The subterranean formation 104 may be made up of several geological layers and include one or more hydrocarbon reservoirs.

The wellbore 102 may be cased with one or more conduits 114 such as casing segments. In some examples, a portion of the well may be open hole (without casing). At least one conduit 114 includes a sealing material (e.g., a sealant 116) to allow for wellbore abandonment. The sealant 116 may be pre-positioned (e.g., before running the casing into the wellbore) around the inner diameter (ID) and/or on the outer diameter (OD) of the tool string (e.g., conduit 114) in order to provide sealing for multiple annuli. Thus, multiple levels of the seal are possible without: (1) needing to cut holes in the tool string; and (2) without needing to remove cement from the wellbore 102.

Additionally, techniques as described herein may ensure that the sealant 116 has reached all of the annuli to provide barriers. In some examples, the sealant 116 is pre-positioned on the ID of the conduit 114 behind a sliding sleeve 118, and on the OD of the conduit 114 as an unprotected sleeve. The sliding sleeve 118 is positioned on the inside of the conduit and initially covers the sealant 116. However, upon actuation of the sliding sleeve 118, the sliding sleeve 118 moves to expose the sealant 116 to the interior (e.g., fluid flow path) of the conduit 114. The sliding sleeve 118 may be actuated mechanically (e.g., a ball, a dart). The sealant 116 may be disposed between the ID of the conduit 114 and the sliding sleeve 118.

In some examples, pumping equipment (e.g., a pump 124 and a fluid source 126, a conduit 127) may be implemented to move components (e.g., a dart, a heater) into the wellbore 102. These components may include permanent fixtures for the wellbore 102. A cable assembly 128 (e.g., slickline) may also be used at the wellsite 110 to move retrievable components into and out from the wellbore 102. For example, the heater may be lowered into the wellbore 102 via conveyance 130 (e.g., a cable) to heat the sealant 116 and then is subsequently removed from the wellbore 102.

Figure 2:
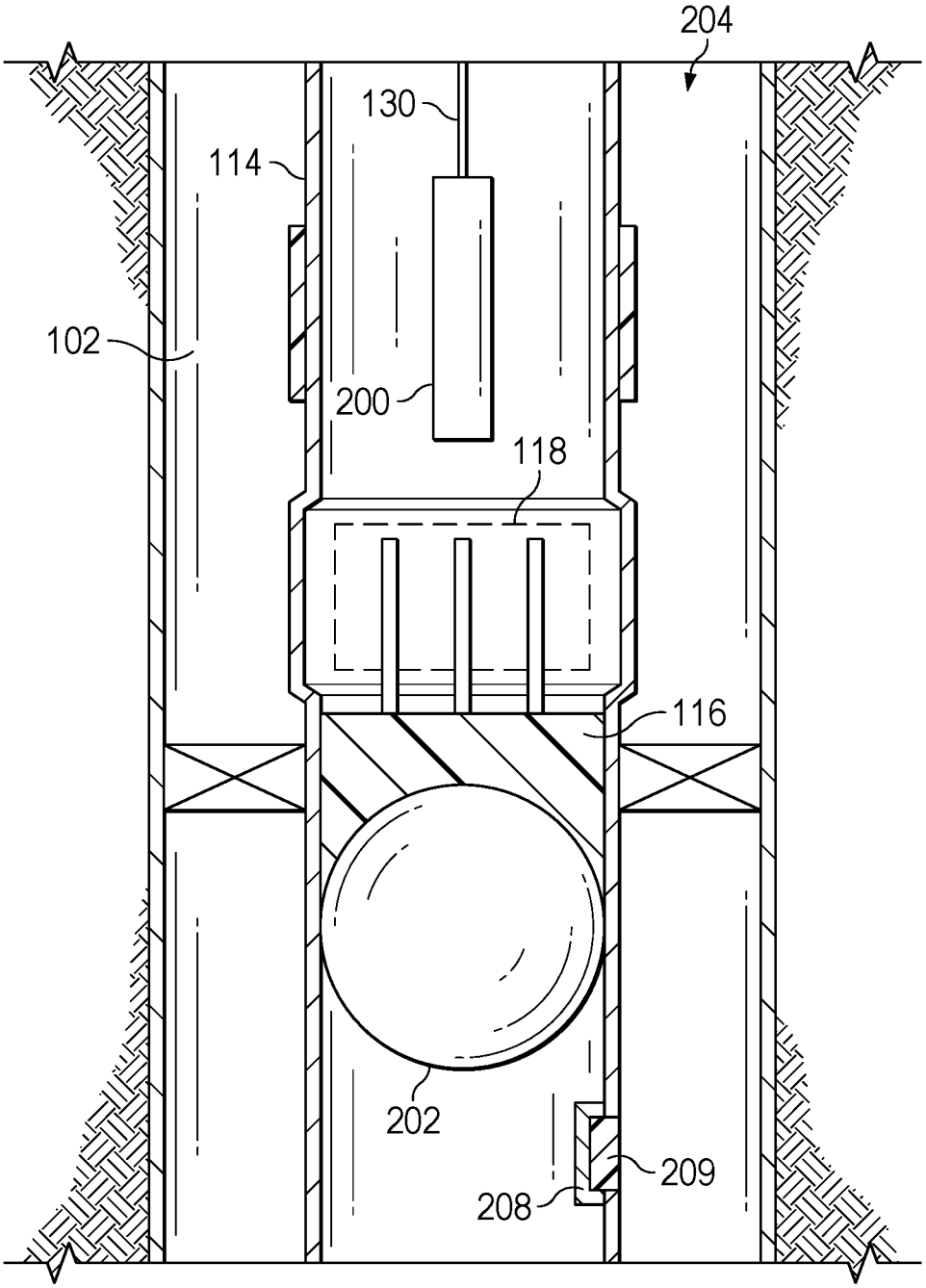
FIG. 2 illustrates a close-up view of a conduit with a sliding sleeve actuated, in accordance with examples of the present disclosure.

FIG. 2 illustrates a close-up view of the conduit with the sliding sleeve actuated, in accordance with some examples of the present disclosure. The conduit 114 (e.g., a completion) may be run into the wellbore 102. The sliding sleeve 118 may be actuated to uncover the sealant 116. The sliding sleeve 118 may include a moveable sleeve disposed on an interior of the conduit. The sliding sleeve 118 may be actuated to uncover the sealant to facilitate heating via a heater that may be positioned in the well. For example, a heater 200 may be run into the wellbore 102 via a cable assembly including a conveyance 130 (see also FIG. 1). The heater 200 provides sufficient heat (e.g., up to 300° C.) to melt the sealant 116 causing the sealant 116 to flow inside the conduit 114, as illustrated. After melting the sealant 116, the heater 200 may be removed from the wellbore 102.

In some examples, a component 202 such as a permanent plug or a ball (or dart) may be disposed in the conduit 114 to receive/serve as a support for the molten sealant 116, as the molten sealant 116 cools and solidifies to form the seal inside the conduit 114. For example, a ball or dart may be dropped (e.g., during installation of the conduit 114) into the conduit 114 to create a support for the molten sealant 116. An annulus 204 is disposed between the conduit 114 and a wall 206 (e.g., wall of the wellbore 102 or another conduit) and may receive the flowing/molten sealant 116. The component 202 may also be used to actuate the sleeve 118 (e.g., by moving the sleeve 118 downward) as the component 202 passes through the conduit 114. In some examples, rather than using a ball, a spring-loaded valve 208 may be disposed in the wall of the casing string and held in place with a material 209 with a lower melting point than the meltable sealant 116, allowing for the spring-loaded valve 208 to deploy quickly and provide the seal.

The meltable sealant 116 may include a metal alloy with a low melting point, such as a bismuth alloy. The alloy can be eutectic, hypoeutectic, or hypereutectic. These materials may be referred to as fusible alloys. The fusible alloy is a metal or a metal alloy with a melting point that may be less than 300° C. (e.g., 100° C. to 300° C.). The meltable sealant has the option of being set or not-set (e.g., an anchor). The fusible alloys expand as they solidify. This expansion assists in the sealing strength of the materials. The volume expansion from solidification is generally small but the materials result in a high sealing force.

Bismuth alloys have 1% to 2% expansion as they solidify. Gallium alloys expand up to 3% on freezing. This compresses the alloy and enhances the seal. Other metal and metalloid alloys that can expand upon freezing include antimony, gallium, germanium, and plutonium. Examples of phase change metallic alloys that expand upon freezing are shown in Table 1.

TABLE 1

Examples of phase change metallic alloys that expand upon freezing.

| Composition | Freezing Point | Volume Expansion at freezing | Tensile Strength |
|---|---|---|---|
| 100% Ga | 85° F. | 3.1% | 2100 psi |
| 45% Bi, 23% Pb, 8% Sn, 5% Cd, 19% In | 117° F. | 1.4% | 5400 psi |
| 43% Bi, 38% Pb, 11% Sn, 9% Cd | 160° F.-190° F. | 2.0% | 5400 psi |
| 48% Bi, 28% Pb, 15% Sn, 9% Sb | 218° F.-440° F. | 1.5% | 13000 psi |
| 55% Bi, 45% Pb, | 255° F. | 1.5% | 6400 psi |
| 100% Bi | 520° F. | 3.3% | 2900 psi |

In some examples, the meltable sealant 116 may include a thermoplastic. The thermoplastic melts, flows, solidifies, to produce/provide the seal. The thermoplastic provides a long-life barrier for plug-and-abandonment of a well. The meltable material may be a combination of thermoplastic and the fusible alloy. The molten thermoplastic has a higher viscosity than the molten fusible alloy. As a result, the molten thermoplastic can serve as a barrier to help hold the molten fusible alloy in position. Additionally, the thermoplastic and the fusible alloy may have different melting temperatures. Examples of thermoplastics include ABS, PE, Nylon, PEEK, PET, PPE, PVC, PEI, PPS, PI, and/or TPE.

Figure 3:
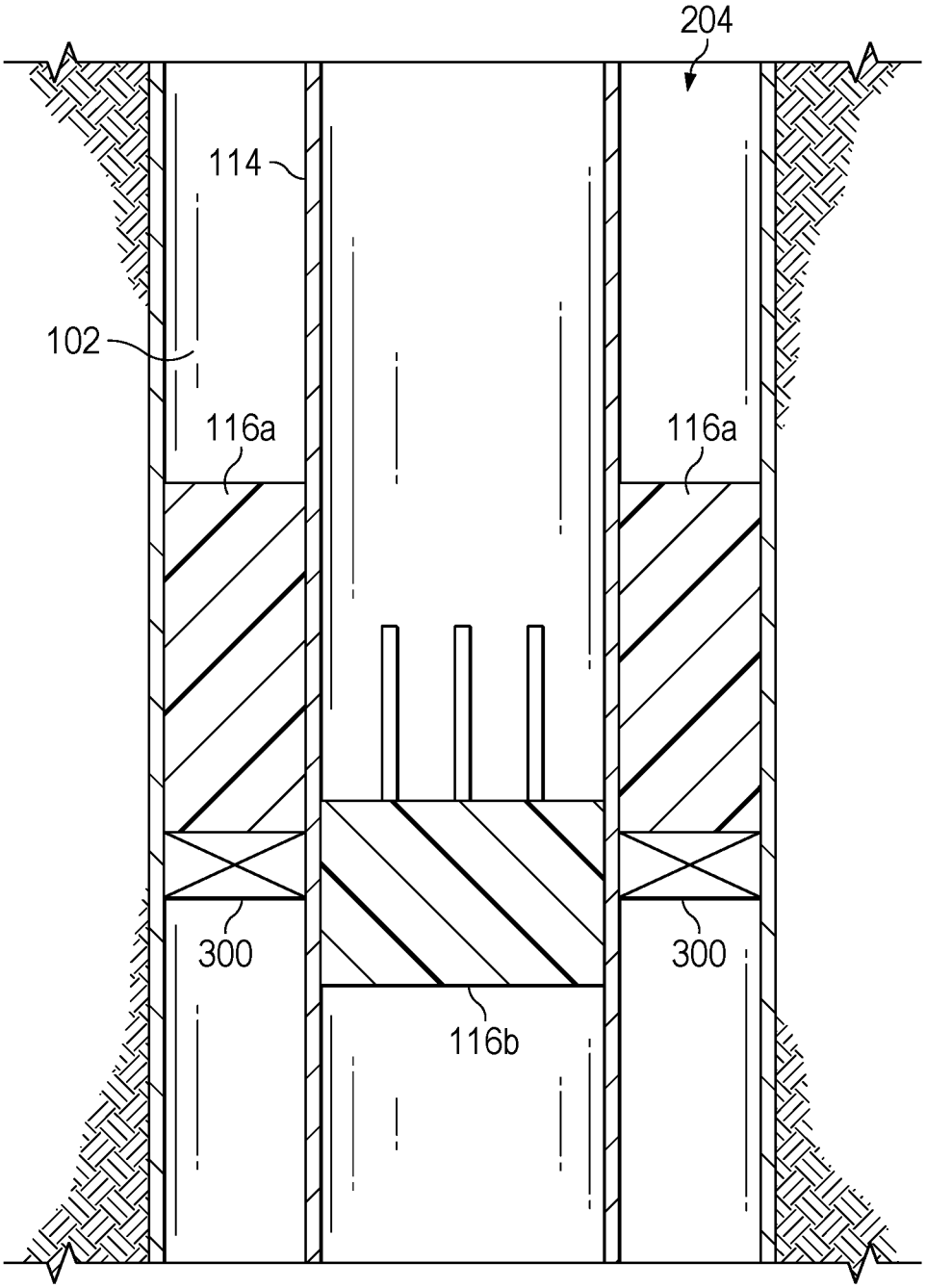
FIG. 3 illustrates a close-up view of the conduit with the sealant formed as plugs in the wellbore, in accordance with examples of the present disclosure.

FIG. 3 illustrates a close-up view of the conduit with all of the sealant formed as plugs in the wellbore, in accordance with some examples of the present disclosure. Sealant 116*a* that was disposed on the OD of the conduit 114 has melted, flowed onto portions of a packer 300 (or other component of a tool string), and solidified thereon, to plug the annulus 204. Sealant 116*b* that was uncovered by the sliding sleeve has melted and flowed to the interior/flow path of the conduit and solidified as a plug to block fluid flow in the conduit 114.

Figure 4A:
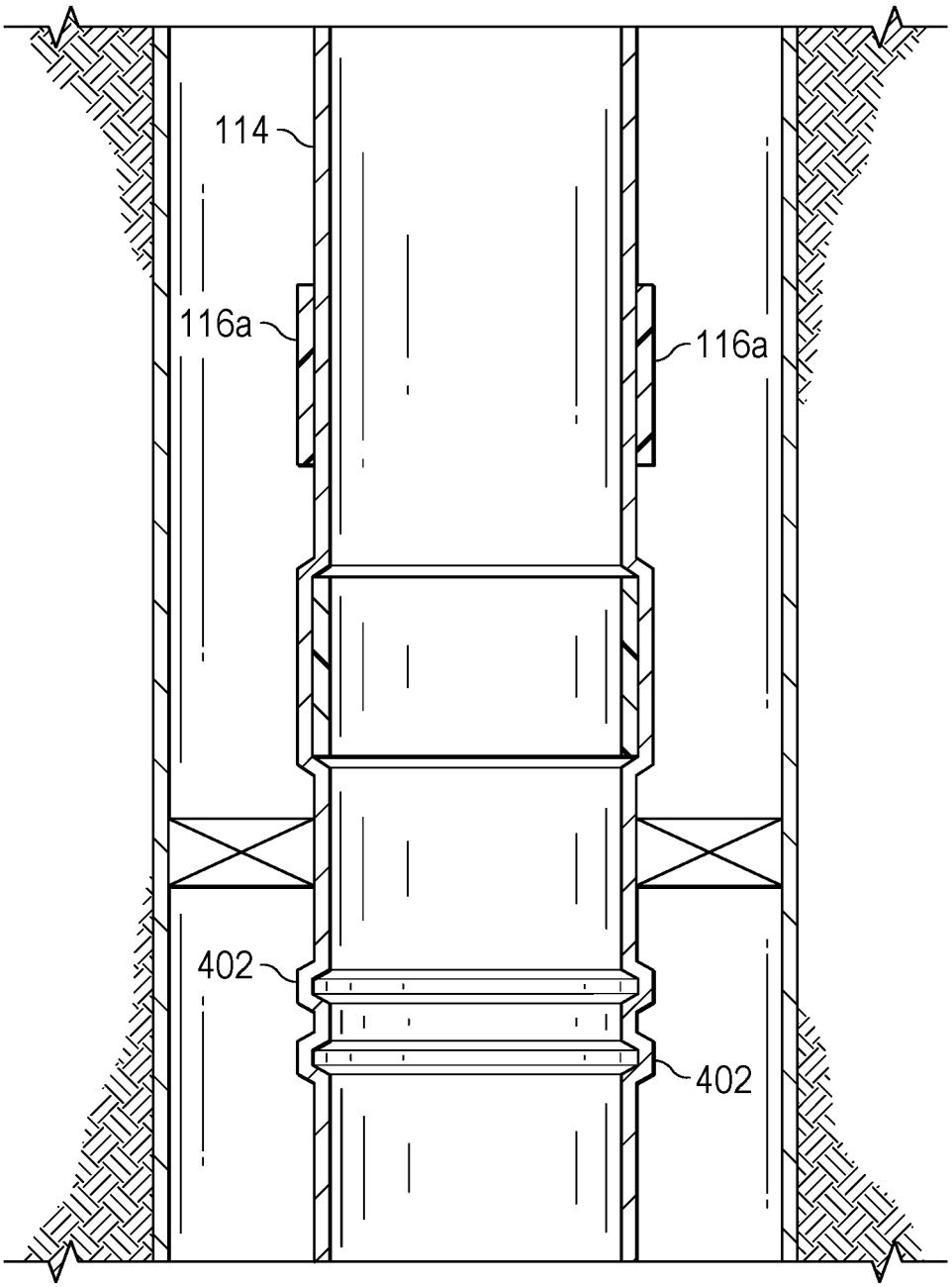
FIG. 4A-4C illustrates plugging the conduit without the sliding sleeve, in accordance with examples of the present disclosure.
Figure 4B:
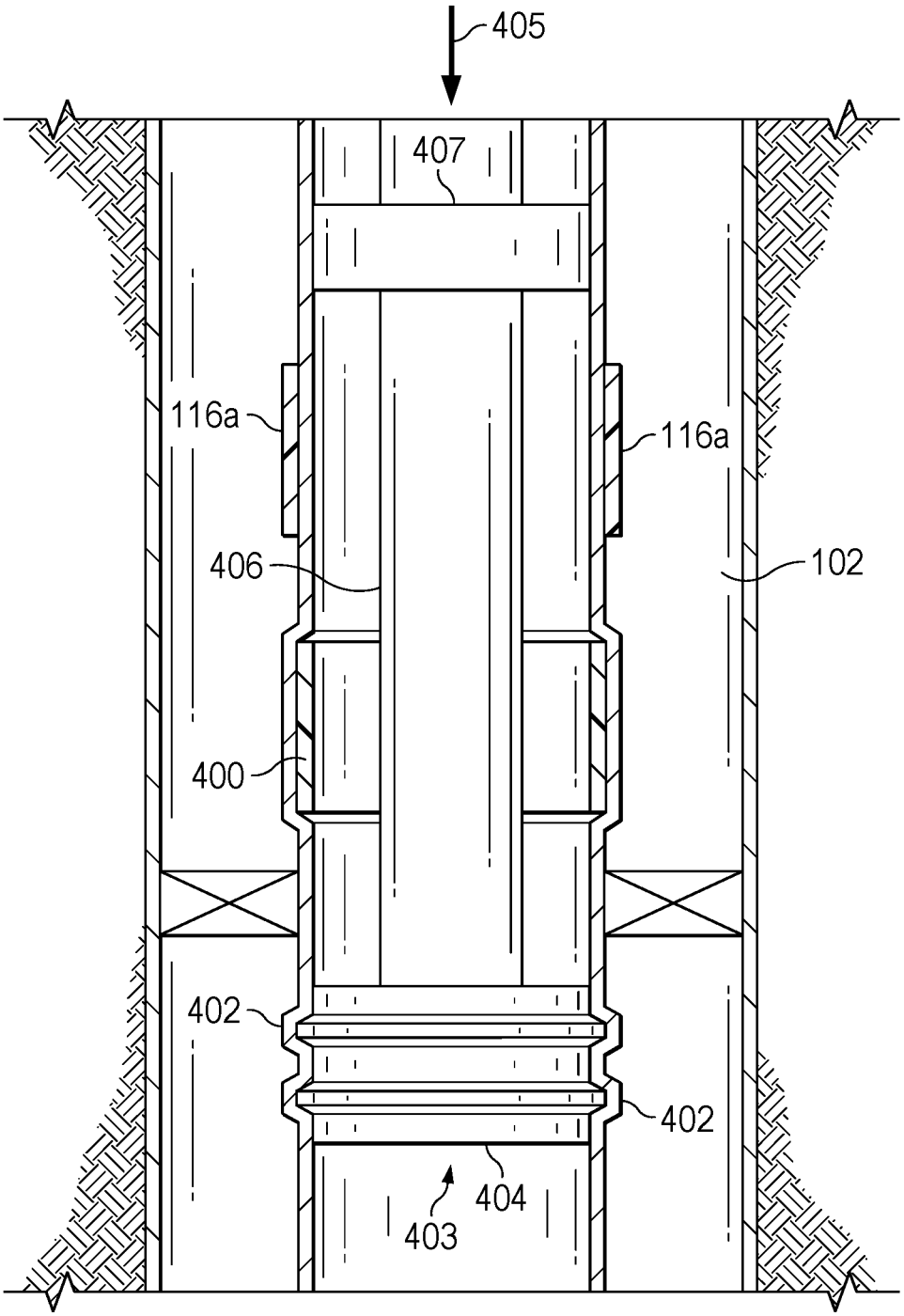
Figure 4C:
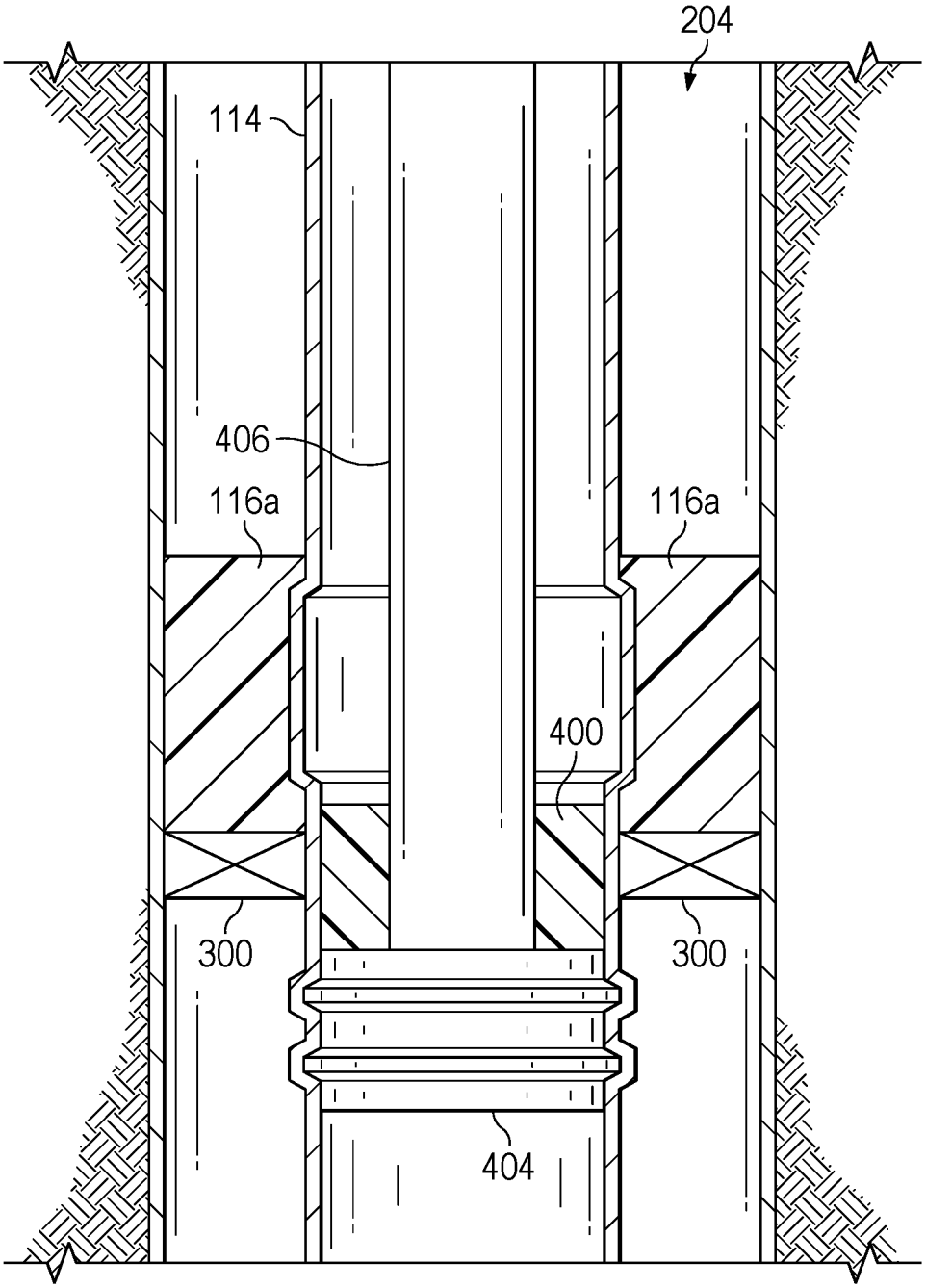

FIGS. 4A-4C illustrate plugging the conduit without the sliding sleeve, in accordance with examples of the present disclosure. As shown on FIG. 4A, a sealant 400 is not protected by a sliding sleeve. Rather than the sliding sleeve/movable sleeve, a sleeve/band of the sealant 400 may be disposed on the ID of the conduit 114. The conduit 114 may also include locking profiles 402 to receive a dart. The conduit 114 also includes sealant 116*a* disposed on the OD.

For example, as shown on FIG. 4B, a dart 404 is pumped to a location 403 and latches at the location 403 via locking profiles 402. Fluid 405 is pumped into the wellbore 102 via pumping equipment (see FIG. 1). A heater 406 (e.g., exothermic chemical heater) provides heat, which melts the sealant 400 and the sealant 116*a*. In some examples, the heater 406 becomes part of the barrier/seal (e.g., permanent placement/not retrievable/), thereby allowing a lesser amount of fusible alloy to be used for sealing. This allows all required components (e.g., heater, dart) to be pumped into position without a slickline run. In some examples, the heater 406 may be attached to the dart 404 and pumped together. In other examples, each component may be pumped separately. The heater 406 may stop producing heat upon completion of the exothermic chemical reactions, thus allowing cooling and solidifying of the sealant. In some examples, the heater 406 may include a wiper or other axial flow restrictor 407 on the OD of the heater 406. The axial flow restrictor 407 facilitates pumping of the heater 406 into position. The axial flow restrictor 407 also concentrates the heat near the sealant 116*a* and the sealant 400 by preventing conduction flow from moving the heat away from the sealant 116*a* and the sealant 400.

FIG. 4C illustrates a close-up view of the conduit with all of the sealants formed as plugs in the wellbore, in accordance with some examples of the present disclosure. The sealant 116*a* that is disposed on the OD of the conduit 114 has melted, flowed onto portions of the packer 300, and solidified thereon, to plug the annulus 204. The sealant 400 has melted and flowed against portions of the heater 406 and the dart 404 and solidified as a plug inside of the conduit 114.

Figure 5:
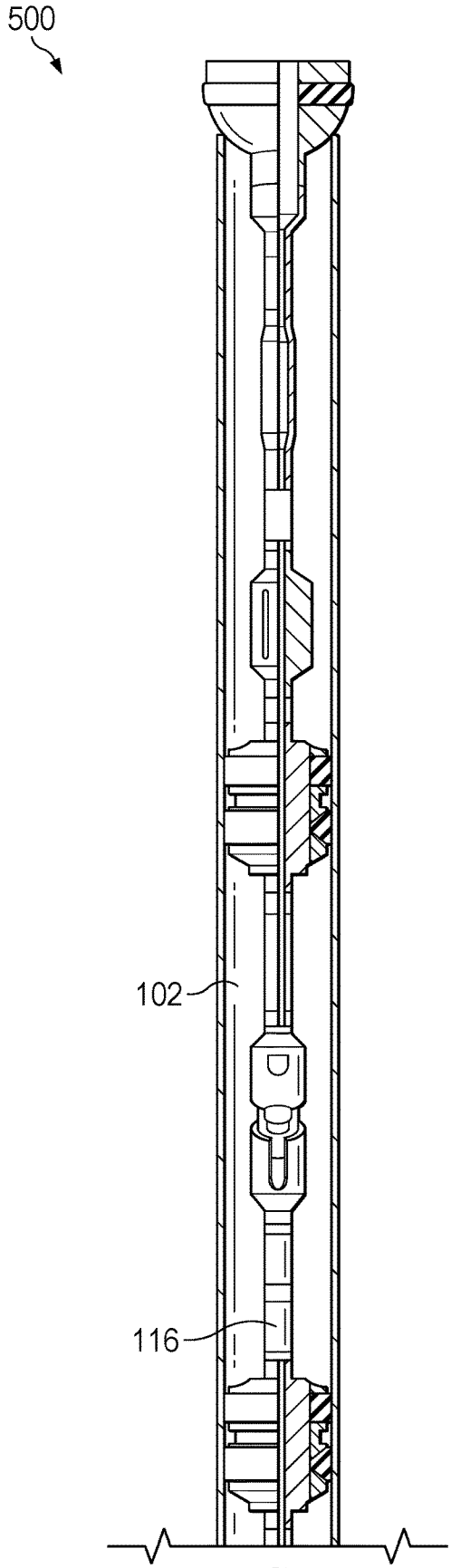
FIG. 5 illustrates that the sealant may be set or not-set in a wellbore, in accordance with examples of the present disclosure.

FIG. 5 illustrates that the sealant may be set or not-set in a wellbore, in accordance with examples of the present disclosure. A tool string 500 may be disposed/run into the wellbore 102. A sleeve of the sealant 116 may be disposed around a portion of the tool string 500. The sealant 116 may serve as an anchor in some scenarios to suspend a portion of the tool string 500 in the wellbore 102. Choosing whether to melt, seal, and lock the completion (e.g., the tool string 500) in place is an option.

Figure 6:
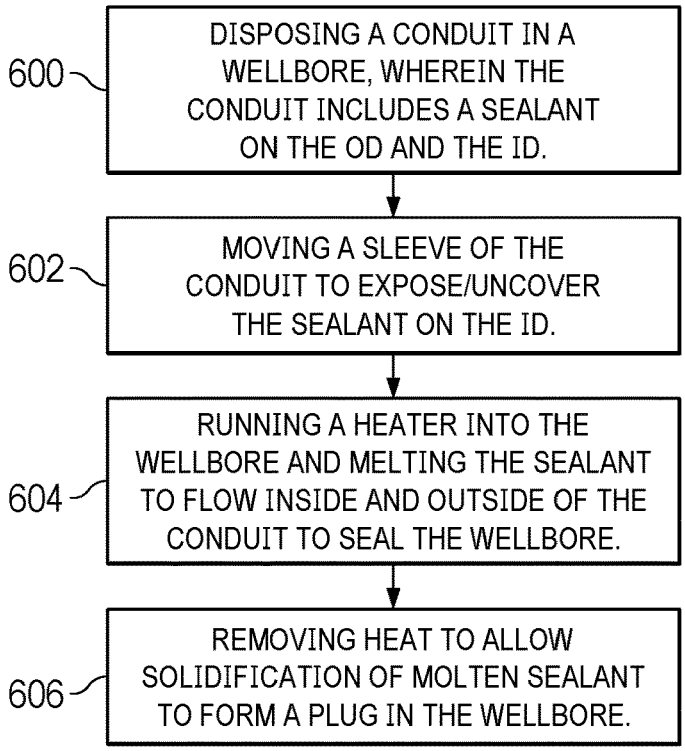
FIG. 6 illustrates an operative sequence for plug and abandonment operations for a well, in accordance with examples of the present disclosure.

FIG. 6 illustrates an operative sequence for plugging and abandoning a well, in accordance with examples of the present disclosure. At step 600, a conduit including the sealant on the OD and ID may be disposed in a wellbore (see FIG. 1). The sealant may include a metal with a low melting point, such as a bismuth alloy. The alloy may be eutectic, hypoeutectic, or hypereutectic. The fusible alloy is a metal or a metal alloy with a melting point that is less than 300° C. These materials may be referred to as fusible alloys.

In some examples, the sealant may include a thermoplastic. The thermoplastic melts, flows, solidifies, to produce the seal. The meltable material may be a combination of thermoplastic and the fusible alloy. The molten thermoplastic has a higher viscosity than the molten fusible alloy. As a result, the molten thermoplastic can serve as a barrier to help hold the molten fusible alloy in position. Additionally, the thermoplastic and the fusible alloy may have different melting temperatures. Examples of thermoplastics include ABS, PE, Nylon, PEEK, PET, PPE, PVC, PEI, PPS, PI, and/or TPE.

At step 602, a sliding sleeve of the conduit is moved to expose the sealant that is disposed on the ID beneath the sliding sleeve (e.g., see FIG. 2). For example, the sliding sleeve may be actuated to uncover the sealant such that the sealant is exposed to an interior/flow path of the conduit to receive without obstruction, heat from a heater. A ball or dart may be used to actuate the sliding sleeve by moving the sliding sleeve downward as the ball/dart passes through the conduit. In some examples, rather than using a ball/dart, a spring-loaded valve may be disposed in the wall of the casing string and held in place with a material with a lower melting point than the meltable sealant, allowing for the spring-loaded valve to deploy quickly and provide a seal. The ball or dart may also create a support for molten sealant because it may lodge in the conduit.

At step 604, heat is applied to the sealant. For example, a heater may be run into the wellbore (e.g., see FIG. 2). The heater provides sufficient heat to melt the sealant causing the sealant to flow inside of the wellbore. The heater may include an exothermic heater that generates heat based on exothermic chemical reactions. The molten sealant may flow into an annulus of the wellbore and/or in the conduit to plug the wellbore. For example, the sealant flows around the OD and the ID of the conduit. At step 606, after melting the sealant, the heater may be removed from the wellbore, and the sealant solidifies (as it cools) and plugs the wellbore as shown on FIG. 3. For example, the sealant solidifies around the OD and the ID to form the plug/seal as heat is removed.

Figure 7:
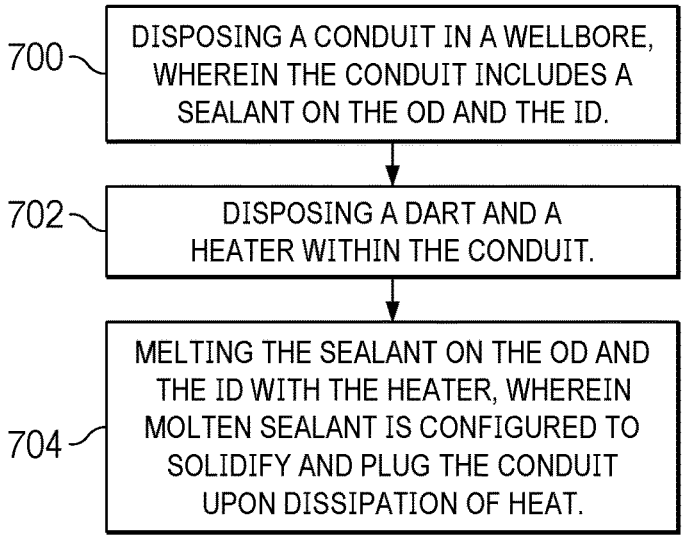
FIG. 7 illustrates another operative sequence for plug and abandonment operations for the well, in accordance with examples of the present disclosure.

FIG. 7 illustrates another operative sequence for plugging and abandoning a well, in accordance with examples of the present disclosure. At step 700, a conduit including the sealant on the OD and ID may be disposed in a wellbore (see FIG. 1). The sealant may include a metal with a low melting point, and/or a thermoplastic, as described above.

At step 702, a dart and a heater may be disposed/pumped into the conduit (see FIG. 4B). For example, a dart is pumped to a location and latches at the location via locking profiles (e.g., see FIG. 4B). Fluid is pumped into the wellbore via pumping equipment (see FIG. 1). A heater (e.g., exothermic chemical heater) provides heat, which melts the sealant and the sealant. In some examples, the heater becomes part of the barrier/seal (e.g., permanent placement/not retrievable/), thereby allowing a lesser amount of fusible alloy to be used for sealing. This allows all required components (e.g., heater, dart) to be pumped into position without a slickline run. In some examples, the heater may be attached to the dart and pumped together. In other examples, each component may be pumped separately.

At step 704, the sealant that is disposed on the OD and the ID of the conduit melts. The sealant flows along the ID and the OD of the conduit. The sealant solidifies and plugs the wellbore upon dissipation of heat. The sealant on the OD solidifies to plug the wellbore outside of the conduit. The sealant disposed on the ID of the conduit melts and flows against portions of the heater and the dart and solidifies as a plug inside of the conduit (e.g., see FIG. 4C). Cooling of the sealant occurs as the heater stops producing heat due to completion of the exothermic chemical reactions. The heater and the dart/plug may become a part of the permanent barrier/seal. That is, the heater, the dart, and the solidified sealant form the plug within the conduit providing for a robust barrier.

Accordingly, the systems and methods of the present disclosure allow for plugging and abandoning of wells with meltable sealants, without a rig or extensive mobilization and trips into the wellbore. The systems and methods may include any of the various features disclosed herein, including one or more of the following statements.

Statement 1. A method comprising moving a sliding sleeve of a conduit to expose a meltable sealant that is pre-installed on an inner diameter (ID) of the conduit, wherein the conduit is disposed in a wellbore, and wherein the meltable sealant is configured to melt and flow upon heating, the meltable sealant further configured to cool, solidify, and plug the conduit upon dissipation of heat.

Statement 2. The method of the statement 1, further comprising disposing a ball or dart in the conduit.

Statement 3. The method of the statement 1 or the statement 2, further comprising moving the sleeve with the ball or the dart.

Statement 4. The method of any one of the statements 1-3, further comprising melting the sealant and supporting molten sealant with the ball or the dart.

Statement 5. The method of any one of the statements 1-4, further comprising melting sealant that is pre-installed on an outer diameter of the conduit.

Statement 6. The method of any one of the statements 1-5, wherein the sealant includes a metal and/or a thermoplastic.

Statement 7. The method of any one of the statements 1-6, further comprising expanding a valve that is attached to the ID with a material that includes a lower melting temperature than the sealant.

Statement 8. The method of any one of the statements 1-7, further comprising melting the sealant via exothermic chemical reactions.

Statement 9. A method comprising: disposing a plug in a conduit, wherein sealant is disposed on an internal diameter of the conduit; positioning a heater in the conduit, the conduit disposed in a wellbore; and melting the sealant with the heater, wherein molten sealant is configured to solidify and seal the conduit upon dissipation of heat from the heater to form a barrier made of the plug, the heater, and the sealant.

Statement 10. The method of the statement 8 or 9, further comprising melting sealant that is disposed on an outer diameter of the conduit.

Statement 11. The method of any one of the statements 8-10, further comprising locking the plug within the conduit with locking profiles.

Statement 12. The method of any one of the statements 8-11, wherein the sealant includes a metal and/or a thermoplastic.

Statement 13. The method of any one of the statements 8-12, wherein the heater is pumped into the conduit.

Statement 14. The method of any one of the statements 8-13, further comprising producing heat with the heater via exothermic chemical reactions.

Statement 15. A system comprising: a conduit; a sealant disposed on an inner diameter (ID) of the conduit, the sealant configured to melt and solidify to form a plug within the conduit; and a sliding sleeve (SS), wherein the sealant on the ID is disposed between the ID and the SS.

Statement 16. The system of any one of the statements 13-15, wherein the conduit is disposed in a wellbore.

Statement 17. The system of any one of the statements 13-16, wherein the sealant is also disposed on an outer diameter of the conduit.

Statement 18. The system of any one of the statements 13-17, wherein the sealant comprises a metal and/or a thermoplastic.

Statement 19. The system of any one of the statements 13-18, further comprising a heater configured to melt the sealant.

Statement 20. The system of any one of the statements 13-19, further comprising a valve that is attached to the ID with a material that includes a lower melting temperature than the sealant.

Although the present disclosure and its advantages have been described in detail, it should be understood that various changes, substitutions, and alterations may be made herein without departing from the spirit and scope of the disclosure as defined by the appended claims. The preceding description provides various examples of the systems and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the elements that it introduces.

For the sake of brevity, only certain ranges are explicitly disclosed herein. However, ranges from any lower limit may be combined with any upper limit to recite a range not explicitly recited, as well as ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present examples are well adapted to attain the ends and advantages mentioned as well as those that are inherent therein. The particular examples disclosed above are illustrative only and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. A method comprising:

disposing a conduit in a wellbore, wherein the conduit forms an interior flow path for fluids through an interior of the conduit, and wherein the interior flow path extends along a longitudinal axis of the conduit;

moving a sliding sleeve of the conduit;

exposing a meltable sealant that is pre-installed on an inner diameter (ID) of the conduit, applying a heat to the meltable sealant to melt the meltable sealant from a solid state to a molten state;

stopping the heat to the meltable sealant to cool and to solidify the meltable sealant and form a plug in the conduit to block the interior flow path inside the conduit.

2. The method of claim 1, further comprising disposing a ball or dart in the conduit.

3. The method of claim 2, further comprising moving the sliding sleeve with the ball or the dart.

4. The method of claim 2, further comprising supporting meltable sealant in the molten state in the interior flow path with the ball or the dart.

5. The method of claim 1, further comprising melting a second meltable sealant that is pre-installed on an outer diameter of the conduit.

6. The method of claim 1, wherein the meltable sealant includes a metal and/or a thermoplastic.

7. The method of claim 1, further comprising expanding a valve that is attached to the ID with a material, wherein the material has a first melting temperature that is lower than a second melting temperature of the meltable sealant.

8. The method of claim 1, further comprising melting the meltable sealant via exothermic chemical reactions.

9. The method of claim 1, further comprising positioning a heater in the wellbore to heat the meltable sealant.

10. The method of claim 1, wherein the meltable sealant is also on an outer diameter of the conduit.

11. The method of claim 1, wherein the meltable sealant has a melting point of 100° C. to 300° C.

12. A method for plugging a wellbore, comprising:

moving a sliding sleeve of a conduit to expose a meltable sealant that is pre-installed on the conduit, wherein the conduit is disposed in the conduit, wherein the meltable sealant extends along a surface of the conduit;

heating the meltable sealant that has been exposed to cause the meltable sealant to form a molten sealant that flows into an interior flow path inside the conduit, wherein the interior flow extends along a longitudinal axis of the conduit; and stopping the heating to thereby cause the molten sealant to solidify into a plug in the interior flow path that blocks flow in conduit.

13. The method of claim 12, wherein the meltable sealant is also on an outer diameter of the conduit, and wherein the meltable sealant on the outer diameter is also heated to flow into an annulus around the conduit and forms a plug in the annulus when cooled, wherein the meltable sealant in the interior flow path and in the annulus plugs the wellbore to prevent flow through the wellbore.

14. The method of claim 12, further comprising positioning a heater in the wellbore to heat the meltable sealant.

15. The method of claim 14, wherein the heat is not retrievable and forms the plug in the wellbore with the meltable sealant.

16. The method of claim 12, wherein the meltable sealant comprises thermoplastic.

17. The method of claim 12, wherein the meltable sealant has a melting point of 100° C. to 300° C.

18. The method of claim 12, wherein the molten sealant in the interior flow path is supported in a ball or dart in the interior flow while it cools to solidify.

19. The method of claim 18, wherein the heater is left in the wellbore and forms the plug in the wellbore with the meltable sealant.

20. The method of claim 19, wherein the meltable sealant on the outer surface is also heated to flow into an annulus around the conduit and forms a plug in the annulus when cooled, wherein the meltable sealant in the interior flow path and in the annulus plugs the wellbore to prevent flow through the wellbore.

* * * * *